United States Patent [19]

Marzocco

[11] Patent Number: 4,895,064

[45] Date of Patent: Jan. 23, 1990

[54] MACHINE-PISTOL FOR CARTRIDGES OF DIFFERENT TYPES

[75] Inventor: Alessandro Marzocco, Milan, Italy

[73] Assignee: SO.C.I.MI.Societa' Construzioni Industriali Milano S.p.A., Milan, Italy

[21] Appl. No.: 123,154

[22] PCT Filed: Feb. 24, 1987

[86] PCT No.: PCT/EP87/00104

§ 371 Date: Dec. 14, 1987

§ 102(e) Date: Dec. 14, 1987

[87] PCT Pub. No.: WO87/05384

PCT Pub. Date: Sep. 11, 1987

[30] Foreign Application Priority Data

Feb. 27, 1986 [IT] Italy ..... 19566 A/86

[51] Int. Cl.[4] ..... F01B 15/00

[52] U.S. Cl. ..... 89/196; 42/25; 89/151

[58] Field of Search ..... 42/9, 25; 89/151, 194, 89/196

[56] References Cited

U.S. PATENT DOCUMENTS

| | | | |
|---|---|---|---|
| 3,195,408 | 7/1965 | Sherman | 89/196 |
| 3,882,625 | 5/1975 | Tellie | 42/25 |
| 3,967,141 | 6/1976 | Gawlick et al. | 102/210 |
| 4,035,943 | 7/1977 | Civolani et al. | 42/69.03 |

FOREIGN PATENT DOCUMENTS 2326529 1/1975 Fed. Rep. of Germany .

*Primary Examiner*—Harold J. Tudor

*Attorney, Agent, or Firm*—Fleit, Jacobson, Cohn, Price, Holman & Stern

[57] ABSTRACT

A machine pistol for cartridges of different types comprises a barrel, a cartridge chamber within said barrel for housing a cartridge in a firing position, and a magazine for feeding cartridges to the cartridge chamber. A percussion pin is provided for firing the cartridge. A breech block is movable relative to the barrel for actuation of the percussion pin. A longitudinal portion of the breech block has a small radial clearance relative to a wall of the barrel and defines a semicylindrical chamber surrounding the barrel over a certain longitudinal length. The percussion pin is positioned in the wall of the barrel and is radially movable relative to the barrel under the action of a portion of an actuator device movable with the breech block.

2 Claims, 3 Drawing Sheets

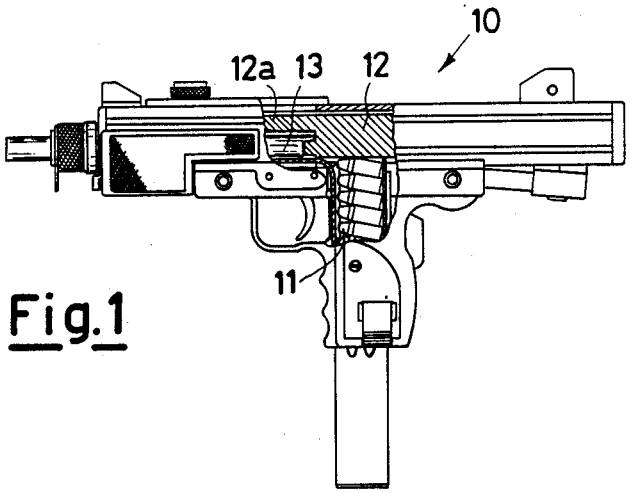
Fig.1
Fig.2
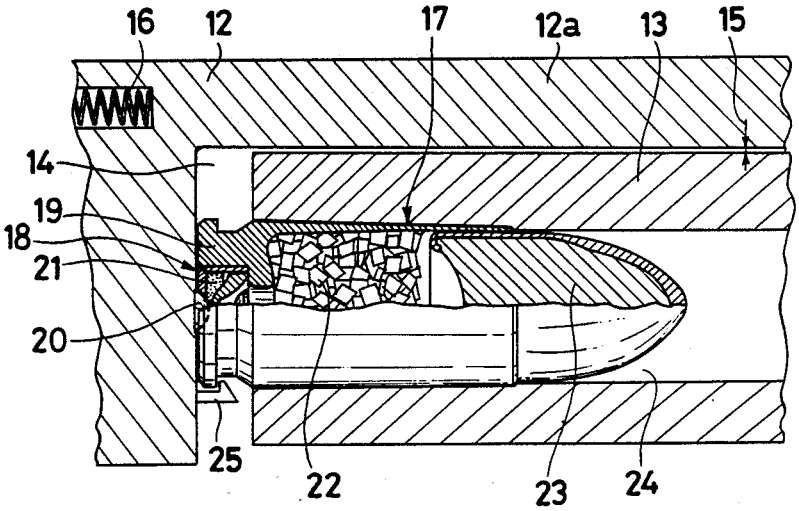

Fig.6
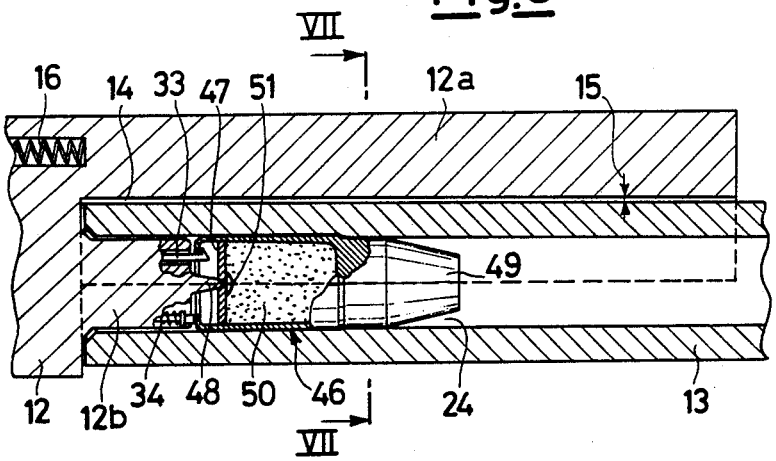
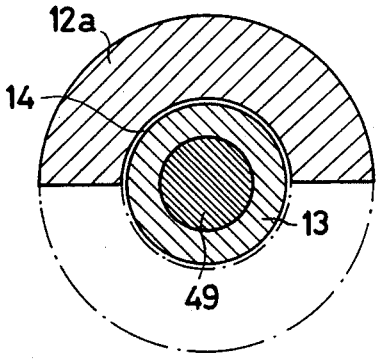
Fig.7
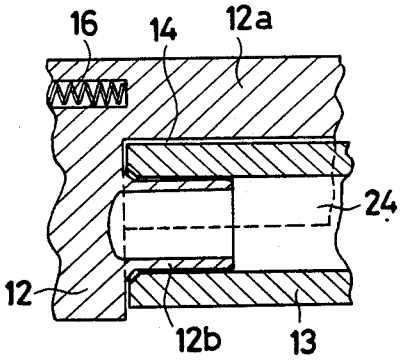
Fig.8

MACHINE-PISTOL FOR CARTRIDGES OF DIFFERENT TYPES

BACKGROUND OF THE INVENTION

The present invention relates to an improved machine-pistol for cartridges of different types.

It is known that a portable weapon of the type defined as a "machine-pistol" is usually designed and manufactured on the basis of the characteristics of one and only one, existing type of standard cartridge.

The consequence of such a usual design is that the use of the machine piston is tied to the use of only that cartridge type the pistol was manufactured for.

The design efforts carried out to date in the field of machine guns have led to accomplishments all directed to the principle of minimizing weight and overall dimensions. However, such guns are usuable only with nine-gauge Parabellum cartridges with cases.

This type of cartridge allows, the use of an extremely simple weapon, thanks to the adoption of the known system of mass shutting.

However, caseless cartridges also exist, which, as compared to the cartridges of traditional Parabellum type including cases, have the following basic advantages: caseless cartridges are lighter (about 60%) and hence, with their weight being the same, the number of cartridges in an individual supply can be increased by about 67%; caseless cartridges also have an exit speed higher by about 20% than that of the traditional cartridges, and thus they hit the target with a greater penetration energy at the shooting distance; and caseless cartridges eliminate the bothersome need of recovering the cases at the end of shooting. Also by being formed of one piece only, caseless cartridges are simpler, cheaper, and allow shooting to be carried out in the absolute absence of typical drawbacks caused by the ejection of the cases. Hence, caseless cartridges can be used in full safety on board of any civil or military (terrestrial, maritime, air) transport means, and without damages, malfunctionings or the immobilization being caused to the transport means, in particular to aircraft, wherein it is a matter of flight safety. Finally, caseless cartridges also allow no traces to be left in the postings the shooting was carried out in.

For caseless cartridges, to date no machine pistols have been developed which are endowed with the characteristics of simpleness and of minimum weight and overall dimensions which are typical of the machine pistol for the above mentioned nine-gauge Parabellum cartridge.

SUMMARY OF THE INVENTION

The purpose of the present invention is thus to provide a machine pistol which is easily convertible for the optional use of different cartridge types, i.e., cartridges with cases and caseless cartridges, while maintaining characteristics of structural simpleness and of minimum weight and overall dimensions.

The invention furthermore provides a machine-pistol convertible for the use both of axial-percussion and radialpercussion cartridges, and piezoelectric-priming cartridges.

In view of these purposes, according to the invention, an improved machine-pistol for different types of cartridges is proposed, which comprises a barrel provided with a cartridge chamber for housing a cartridge in its firing position, a magazine for feeding the cartridges, a percussion device for priming the firing, and breech block movable relative to the barrel for actuation of the percussion device. The breech block is provided with a longitudinal portion defining an at least semicylindrical chamber, surrounding, for a certain longitudinal length, the barrel, with a small radial clearance, in a forward position for the actuation of the percussion device.

Advantageously, such a configuration of the breech block and of the barrel allows use of axial percussion or radial percussion, as well as the piezoelectric priming, in as much as the percussion device can be positioned in such a way that it can be optionally actuated by an axial portion of the breech block of the breech block which is or by a portion able to surround, radially from the outside, the barrel. In other terms, the breech block and the barrel of a pistol according to the invention, even if they always have the same basic configuration, are different, from time to time, only as regards the percussion device, or the piezoelectric priming device mounted on the breech block and barrel. By optionally mounting the breech block and the barrel of the specific desired configuration on the weapon, the weapon is able to use several cartridge types. The general outer structure of the weapon remains the same for all of the various cartridge types.

BRIEF DESCRIPTION OF THE DRAWINGS

Further details and advantages of a machine pistol according to the invention result from the following disclosure, made with reference to preferred forms of practical embodiment of the invention illustrated in the hereto attached drawings, wherein:

FIG. 1 is a partly cutaway view of a machine pistol according to the invention;

FIG. 2 is a partly cutaway axial view of the barrel and of the obturator in correspondence of the firing zone of a pistol according to the invention for case cartridges, for example of the nine-gauge Parabellum type, for axial percussion;

FIG. 6 is a sectional view like that of FIGS. from 2 to 5, but relating to a machine pistol according to the invention for caseless cartridges, for axial percussion;

FIG. 7 is a transversal section according to path VII—VII of FIG. 6;

FIG. 8 shows a detail of a variant.

DETAILED DESCRIPTION OF THE PREFERRED EMBODIMENTS

Figure 3:
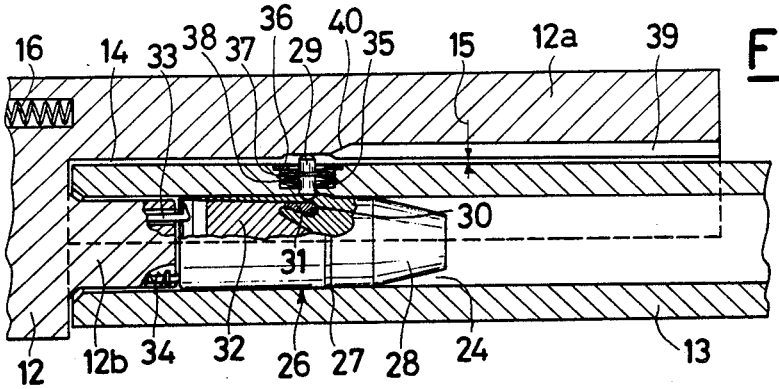
FIGS. 3, 4 and 5 are sectional views, like that of FIG. 2, of machine pistols according to the invention for caseless cartridges of advanced type, for radial percussion.

A machine-pistol 10 according to the invention appears in its entirety in FIG. 1. In the cutaway portion of the machine-pistol, the magazine 11 is recognizable, and the particular shapes of the breech block 12, as well as of the barrel 13, are visible. The elements constitute peculiar features of the invention, as shall be explained presently in greater detail.

The breech block 12 is provided with a longitudinal portion 12*a* which defines a cylindrical or semicylindrical chamber 14. Chamber 14 surrounds for a certain longitudinal length the barrel 13 with a small radial clearance 15. Breech block 12 is in a put-forward position for actuation of the percussion device, to which position it is pushed by a recovery spring 16.

The particular configuration of the barrel 13 and of the breech block 12 allows various percussion devices to be installed. The particular percussion device installed may be of the axial type or of the radial type for the firing of case cartridges or of caseless cartridges.

In FIG. 2, a construction for axial percussion for a cartridge 17 with case 19 of Parabellum type, e.g., of 9-mm gauge is shown.

The firing of cartridge 17 takes place on percussion in the axial direction of the primer 18. Primer 18 is mounted in the rear portion of case 19. The percussion is produced by means of percussion pin 20 integral with the breech block 12 in the portion of the breech block opposite to the barrel 13. The percussion pin 20 is furthermore positioned so as to be lined up with the axis of barrel 13.

In the primer 18,. Priming mixture 21 is housed, causes the firing of gun powder 22. The increase in pressure inside the case 19 causes separation of bullet 23 from the case 19. The bullet 23 continues its run inside the barrel 13 until it is shot out of the barrel.

At the moment of the increase in pressure inside the case 19, the case expands and is retained by friction inside the cartridge chamber 24 of the barrel 13, producing tight sealing to prevent escape of the high-pressure gases.

When the bullet 23 exits the barrel 13, the pressure decreases correspondingly and residual pressure inside the barrel 13 pushes the case 19 and rearwards. The mass of breech block 12 then loads the recovery spring 16.

As it runs rearwards, with the breech block 12, the case 19 is ejected from the weapon by the extractor 25. When the breech block 12 returns forward towards the cartridge chamber 24 of the barrel 13, it draws from the magazine 11 a new cartridge 17. The cycle can automatically continue, according to the position of a special shooting selector, for single shot or for burst shooting.

In FIG. 3, radial percussion for an advanced type of caseless cartridge 26 is shown.

The firing of cartridge 26 takes place on percussion in the radial direction of a zone 27 at the side surface of bullet 28.

The percussion occurs by means of a percussion pin 29, radially guided inside the barrel 13 towards the interior of the cartridge chamber 24. Inside an inner chamber 30 of the side surface of the bullet 28, the priming mixture 31, which causes the firing of the gun powder 32, is housed along the whole circumference of the bullet.

Upon firing the increase in pressure inside the bullet 28 in the hollow wherein the gun powder 32 is contained causes the bullet 28 to move inside the barrel 13. A cylindrical appendix **12*b* of the breech block 12, coaxial with the barrel 13, by penetrating for a certain length the cartridge chamber 24 of the barrel 13**, produces tight sealing to prevent escape of the high-pressure gases.

The mass inertia of breech block 12 makes the breech block move rearwards, under the thrust applied by the high-pressure gases, with a certain time delay relative to the motion of the bullet 28. Therefore, tight sealing to prevent escape of the gases is secured. When the bullet 28 exits the barrel 13, the breech block mass moves rearwards and loads the recovery spring 16.

When the breech block 12 returns towards the cartridge chamber 24 of the barrel 13, is draws another bullet 28 from the magazine 11 and the cycle can automatically continue, according to the position of a suitable known shooting selector, for single shot or for burst shooting,.

In case missed shot due to any cause occurs, the manual rearward movement of breech block 12 causes the ejection of the unexploded cartridge, by means of the extractor 33 and of the spring ejector 34.

The percussion pin 29 is housed in correspondence with the cartridge chamber 24 of the barrel 13 inside a seat 35 provided in the wall of barrel 13. The percussion pin 29 is provided with a retainer split ring 36 as well as with a collar 37, acting as a guide for the pin inside the seat 35. The percussion pin 29, which has the shape of a pin element, is subject to the action of a spring 38, e.g., a Belleville spring, which tends to push the percussion pin 29 radially towards the outside of barrel 13, to keep the radially inner end of pin 29 out of the cartridge chamber 24. Spring 38 acts on collar 37.

The percussion pin 29 has its radially outer end rounded, to facilitate the percussion motion by an actuator device, which can be of various types, and which is integral with the breech block 12.

In FIG. 3, such an actuator device is constituted by a longitudinal groove 39 in portion **12*a* of the breech block 12, having an inclined length 40 which, owing to the forward motion of the breech block, produces radial percussion motion of the percussion pin 29** at the end of forward motion of the breech block during shooting.

Figure 4:
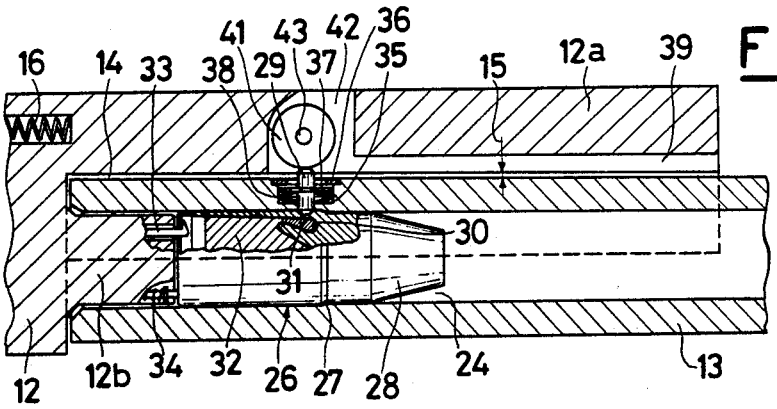

In the example of FIG. 4, the actuator device is constituted by a cylindrical roller 41, rotatably housed inside a hollow 42 of portion **12*a* of the breech block 12. The actuator device is supported by a pivot 43 borne by the breech block 12, with the pivot axis being perpendicular to the axis of the percussion pin. The relative positions of pivot 43 and pin 29 are such that the engagement of the roller 41 with the end of the percussion pin 29 during forward motion of the breech block 12 produces radial percussion motion of the percussion pin 29**.

Figure 5:
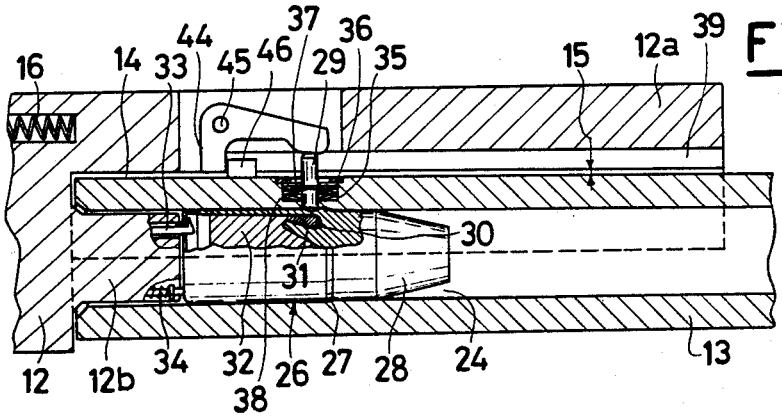

In the embodiment of FIG. 5, the actuator device is constituted by a bell crank 44, hinged onto portion **12*a* of the breech block 12 and movable in a plane passing through the axis of the barrel 13 around a pivot 45 borne by the breech block 12. An arm of the bell crank 44 cooperates with a stop tooth 46, which extends radially and is integral with the barrel 13, during the last portion of the forward motion of the breech block 12. The bell crank arm and stop tooth cooperate in such a way that the other arm of the bell crank 44 causes the percussion movement of the percussion pin 29**.

This practical embodiment has the advantage that the wear of the guide surfaces of the percussion pin 29 and of the barrel 13 are eliminated, in as much as the direction of the resulting actuation force is aligned with the axis of the percussion pin 29.

Another advantage of this embodiment is that because of the shape of the bell crank 44, which is hinged at its central portion, it is possible to obtain different suitable mutual ratios of the lengths of the two arms of the bell crank. It is therefore possible to optimize the ratios for the highest functionality of the device according to the type of radial percussion cartridge used.

In the embodiment of FIG. 5, the vertical arm of the bell crank 44 is shorter than the horizontal arm. In such a way, a necessary and sufficient vertical stroke of the percussion pin 29 is obtained by a very short horizontal stroke of the breech block 12. In as much as actuation of the percussion pin 29 takes place during the end portion of the stroke of the breech 12, shooting safety is also accomplished the firing only takes place when the cartridge chamber 24 is completely blocked by the cylindrical appendix 12*b* of the breech block 12.

In the practical embodiments of FIGS. 3 to 5, when the breech block moves rearwards, the spring 38 facilitates rearward movement of the percussion pin 29. This rearward movement can, however, take place without any spring aids, affected only by gas pressure in the cartridge chamber 24, or by the introduction of a new cartridge into the cartridge chamber 24.

Another feature of the percussion pin 29 is that of having at least three cylindrical elements, which act as a guide and as a "labyrinth" for the tight sealing to prevent escape of the gases created inside the cartridge chamber 24 of the barrel 13.

Advantageously, the split elastic ring 36, once being mounted inside the special ring housing of the seat 35, provides a reliable and easy fastening of the percussion pin 29 to the barrel 13.

In FIG. 6, an axial percussion of a caseless cartridge 46 of advanced type is shown.

The firing of the cartridge 46 occurs at the time of percussion in the axial direction of the disk-shaped primer 47 of the cartridge by means of the percussion pin 48. Percussion pin 48 is integral with the appendix 12*b* of the breech block 12, and shaped as a protrusion of the appendix 12*b*. The axis of the percussion pin is longitudinally lined up with the axis of the barrel 13. The primer 47 has its outer perimeter fastened inside the hollow of the bullet 49 which contains the gun powder 50. The primer 47 contains in its central interior the priming mixture 51 which primes the firing of the gun powder 50. The sequence of the motions of the bullet 49 and of the obturator 12 during the shooting takes place as previously described. In case of a misfire, the ejection of the unexploded bullet 49 occurs again as previously disclosed.

In the variant of FIG. 8, the cylindrical appendix 12*b* of the breech block 12 has a hollow configuration throughout its length. In this case, the extractor and the ejector are structurally arranged in a different way relative to the previously disclosed embodiments.

The hollow structure of appendix 12*b* allows to prevent escape tight sealing of the gases at firing to be improved, because the holow appendix 12*b*, expands due to the effect of the high gas pressure at firing and comes in contact with the inner wall of the barrel 13. When the pressure decreases, during the motion of the bullet inside the barrel 13, the expansion of the hollow appendix 12*b* decreases and the contact with the barrel 13 ends, so that the breech block 12 can freely start its return stroke.

It will be understood from the foregoing how a machine pistol according to the invention is purposely designed for the alternative use of at least two types of cartridges, having different use characteristics, e.g.:

case cartridges, of traditional gauge nine Parabellum type, with axial percussion;

caseless cartridge, of nine gauge special advanced type, with axial percussion, or radial percussion, or with piezoelectric priming.

The present machine pistol has the advantage of being simple, because it uses, for both of the above-noted cartridges, a mass-shutting system. The machine pistol is also flexible, because it is in compliance with the modern trend of being equipped, as much as possible, with weapons endowed with multi-use characteristics.

Some examples have been supplied of configuration of the percussion device, installed on the barrel and/or on the breech block, but it should be understood that the use of percussion devices of many different types is possible, including piezoelectric priming type devices, for cartridges with cases, as well as for caseless cartridges.

By using a machine pistol of the present invention it is possible to be equipped with a bimodal weapon for multi-use, and with an extremely cheap weapon as a function of these characteristics, in addition to all of the advantageous consequences due to the minimum number of spare parts to be stored.

It should be observed that the configuration of the breech block and of the barrel according to the invention also considerably dampens the motion of the breech block mass, and facilitates cooling of the parts of the weapon undergoing heat stress, during shooting, by the effect of the closeness of the parts and of the forced air motion produced by the reciprocating motion of the breech block. Furthermore, the structure according to the invention advantageously constitutes a closed and tightly sealed system for the protection of percussion devices and of piezoelectric-priming devices.

The accomplishment of the above tightly sealed protection system is of basic importance to the reliability of the weapon, the use of which is foreseen to take place both under normal conditions and, and above all, under the extreme conditions as provided by the N.A.T.O. for a war weapon: life, precision, falls, barrel obstruction, prolonged immersion in water, in mud, exposure to rain, sand and in moist high-temperature and low-temperature environments.

I claim:

1. A machine pistol for cartridges of different types, comprising:

a barrel having an axis, a cartridge chamber within said barrel for housing a cartridge in a firing position, a magazine for feeding cartridges to said cartridge chamber, a percussion pin for firing said cartridge, a breech block movable relative to the barrel for actuation of said percussion pin, a longitudinal portion of said breech block having a small radial clearance relative to a wall of said barrel and defining a semicylindrical chamber surrounding the barrel over a certain longitudinal length, said percussion pin being positioned in the wall of the barrel and radially movable relative to said barrel under the action of a portion of an actuator device movable with the breech block, the actuator device including a bell crank hinged on the breech block and movable in a plane passing through the axis of the barrel and a stop tooth, for causing the bell crank to pivot about its hinge, integral with the barrel, said stop tooth located on said barrel in such a position as to engage the bell crank at an end of a forward stroke of the breech block.

2. A machine pistol according to claim 1, wherein the bell crank has a longer arm and a shorter arm, the shorter arm cooperating with said stop tooth and the longer arm cooperating with said percussion pin.

* * * * *